United States Patent [19]

Pavack et al.

[11] 4,133,569

[45] Jan. 9, 1979

[54] GRAPPLING DEVICE WITH COLLAPSIBLE GRIPPING ARMS

[76] Inventors: Donald R. Pavack, 1905 Shenandoah Ave., Milpitas, Calif. 95035; Lawrence D. Sabo, 1777 Trudean, San Jose, Calif. 95132

[21] Appl. No.: 844,796

[22] Filed: Oct. 25, 1977

[51] Int. Cl.[2] ..... B66C 1/10

[52] U.S. Cl. ..... 294/106

[58] Field of Search ..... 294/106, 66 R, 116, 294/108, 109; 114/294, 298, 304

[56] References Cited

U.S. PATENT DOCUMENTS 1,841,721 1/1932 Esary et al. ..... 294/116

FOREIGN PATENT DOCUMENTS 253192 4/1926 Italy ..... 294/66

*Primary Examiner*—James B. Marbert

*Attorney, Agent, or Firm*—Julian Caplan

[57] ABSTRACT

Three gripping arms are held either in work or storage position, and in storage position the sharp points of the arms are protected from injuring personnel. A line is attached to an eye on the lower end of a stem, the upper end of the stem being threaded. A spreader having three radial slots is fixed a set distance below the upper end of the stem. The upper ends of gripping arms, which are pointed at their lower ends, fit into the slots and are pivoted to the spreader. A hollow nut threaded on the stem has a cam surface which cooperates with cam surfaces on the upper ends of the arms to hold the arms either in outwardly-spread work position or collapsed storage position.

7 Claims, 5 Drawing Figures

GRAPPLING DEVICE WITH COLLAPSIBLE GRIPPING ARMS

This invention is, in part, the subject of Disclosure Document 051,177.

This invention relates to a new and improved grappling device with collapsible gripping arms. More particularly the device has three arms or claws which are curved and pointed at their lower ends, pivotally mounted on a spreader attached near the upper end of a stem, the lower end of the stem having an eye to which a line is attached. Means is provided to hold the grappling arms either in use position with the arms spread outward from the stem or in collapsed position with the points drawn together adjacent the central axis of the stem.

When the device is in use position, it is used as an aid in climbing in usual fashion. In other words, the user grips the line attached to the eye and uses the line to cast the device upward, the arms snagging on some projection which will support the weight of the user climbing the line. Thus the device has use for climbing, pulling and many similar uses. A particular use is in law enforcement, but the device also has military, fire-fighting and mountaineering uses, as well as others.

In the collapsed position, the points of the arms are not exposed and hence are not likely to injure personnel. This is particularly important where the device is being carried or is attached to a belt or other portion of the clothing of the user in the event that the user stumbles or falls. Heretofore serious injuries have occurred in such situations.

A particular feature of the invention is the ease with which the arms may be changed from transport to use positions and may be secured in either position. Such ease is particularly important because the rapidity with which the device may be shifted from work to storage position and vice versa is quite important in practical use.

Another advantage of the invention is the fact that the means for locking the arms in one position or the other does not materially increase the weight or cost of the device.

When collapsed, the device is portable, easily carried, and compact in size.

Other objects of the present invention will become apparent upon reading the following specification and referring to the accompanying drawings in which similar characters of reference represent corresponding parts in each of the several views.

The device of the present invention is intended for rapid and simple adjustment between storage and use positions. For such purpose a long stem 11 is provided, preferably round steel rod, formed with an eye 12 at its lower end and having a threaded portion 13 at its upper end. A line 14 may be knotted to the eye 12 in conventional manner in the use of grappling hooks.

Figure 1:
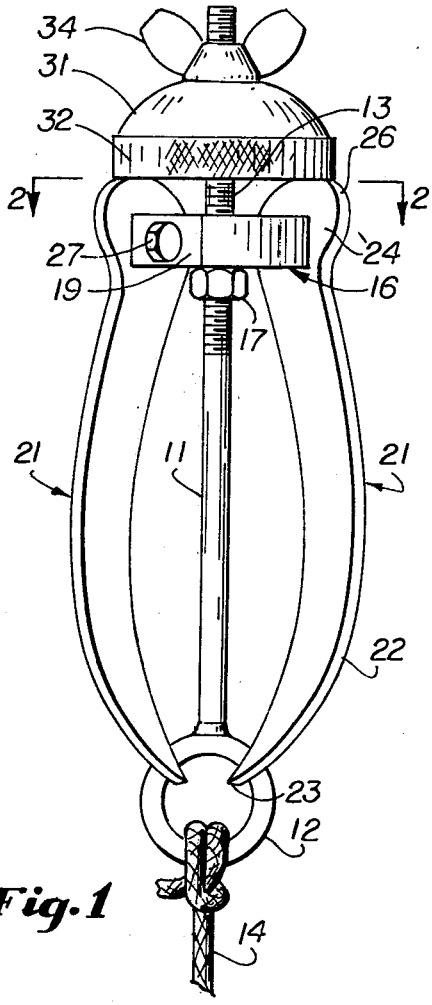
FIG. 1 is an elevational view of one form of the invention showing the device in collapsed or storage position.
Figure 2:
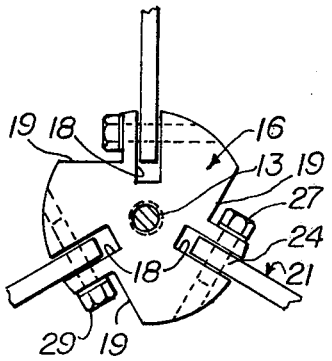
FIG. 2 is a sectional view taken substantially along the line 2 — 2 of FIG. 1 with the arms being broken away to conserve space.

A spreader disc 16 is shown in the modifications of FIGS. 1 and 2 spaced downward from the upper end of the stem 11. In the preferred form shown in the drawings, a threaded hole is formed in the center of the disc 16 and is threaded over the portion 13 of stem 11 and secured in position by lock nut 17 on stem 11. It will be understood, however, that the disc 16 may be fixed relative to the stem 11 in some other manner.

Assuming that three arms 21 are to be incorporated in the device, three radial slots 18 are formed in the disc 16, and likewise three notches 19 are formed therein to support the arms 21 as hereinafter explained.

Arms 21 are generally of the shape of grappling hook arms in that they have a curved, claw-like shape. Below the central portion 22 are tapered, inward directed, points 23. The upper ends 24 fit into the slots 18 and above the upper ends 24 are cam surfaces 26. Ends 24 are apertured and bolts 27 fitting into the notches 19 pass through the holes in the ends 24 and are threaded into holes in disc 16 as best shown in FIG. 2. Thus the arms 21 are secured relative to the disc 16 and are pivotable between the collapsed position of FIG. 1 and the extended or use position of FIG. 3.

Threaded onto the threaded portion 13 at the upper end of stem 11 is a hollow nut 31, preferably round and having a knurled rim 32. The underside interior portion of nut 31 has a concave cam surface 33 which cooperates with the cam surfaces 26 of arms 21 to hold the arms 21 in either of their positions of adjustment. Directing attention to FIG. 1, the lower edge of nut 31 rests on the cam surface 26 of each arm 21 and prevents upward swinging of the arms 21, thereby holding the arms in storage position.

By backing off the lock wing nut 34 and then the hollow nut 31, the nut 31 may be raised from the position of FIG. 1 so that the lower edge thereof does not rest on the cam surfaces 26. Thereupon the arms 21 may be swung out to the position of FIG. 3. By again turning down the nut 31 and the lock nut 34, the cam surface 33 bearing against the surfaces 26 forces the arms 21 out and locks them in the outward or use position of FIG. 3. Accordingly the device is easily and rapidly adjusted between the positions of FIGS. 1 and 3. When in the position of FIG. 1, the points 23 are disposed inwardly and are preferably at least partially within the eye 12 and thus users are protected against injury or snagging of the points 23. When in the expanded or use position of FIG. 3, the device may be used in the manner of all other grappling hooks.

Figure 4:
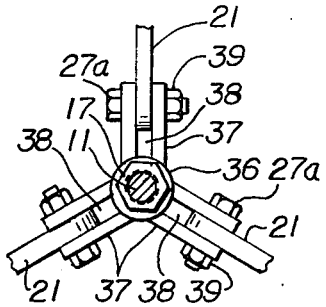
FIG. 4 is a fragmentary sectional view taken substantially along the line 4 — 4 of FIG. 3, showing the modification of FIG. 3.

The modification of FIGS. 2 and 4 resides only in the shape of the spreader **16*a* as contrasted with the spreader 16 of FIGS. 1 and 2. In this form of the invention, there is a central hub 36 which is threaded for engagement with the end 13 of stem 11 and from which extend three angular members 37, each 120° apart, the adjacent arms 37 being separated by a space 38 in which pivots arm 21. In this form of the invention, the bolts 27*a* and are held in position by nuts 39**.

Figure 5:
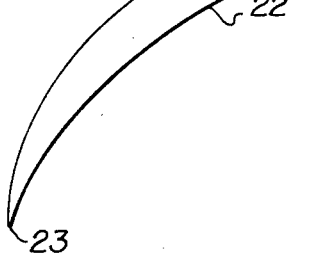
FIG. 5 is a fragmentary view similar to FIG. 2 of a further modification.
Figure 5:
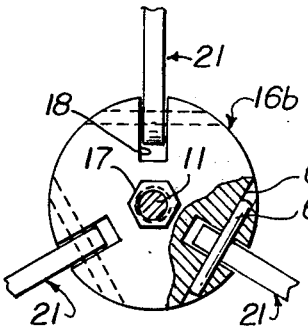

The modification of FIG. 5 is similar to the structure shown in FIG. 2 except that notches 19 are eliminated, as are bolts 27. Pins 61 pass through holes 62 in disc **16*b*** and the hole in arm 21 and are welded or otherwise fixed to disc 16*b*.

Figure 3:
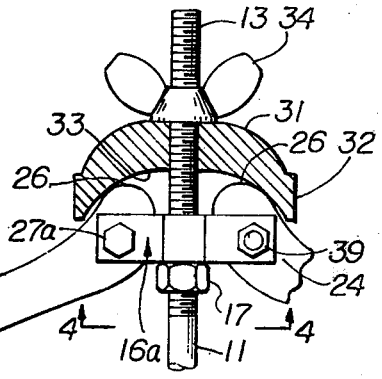
FIG. 3 is fragmentary elevational view partly broken away in section, showing the arms in spread or use position, a portion of the structure of FIG. 3 being a modification of the corresponding portion of FIGS. 1 and 2.

In other respects the modification of FIGS. 3 and 4 and the modification of FIG. 5 resemble that of FIGS. 1 and 2 and the same reference numerals are used to designate corresponding parts except that in so far as the spreader is concerned the same reference numerals as in FIGS. 1 and 2 are used to designate corresponding parts followed by the subscripts a and b, respectively.

What is claimed is:

1. A grappling device comprising a stem, first means at a first end of said stem for attachment of a line, the second end of said stem for attachment of a line, the second end of said stem opposite said first end being threaded, a spreader on said stem adjacent but spaced inwardly of said second end, said spreader being formed with a plurality of radial slots, a plurality of curved grappling arms, each said arm having a distal point and a proximal end formed with a first cam surface, second means pivotally mounting each said arm in one of said slots for swinging movement between a storage position with said points positioned inward vicinal said stem and a use position with said points remote from said stem, and a hollow nut threaded on said second end of said stem, said nut having a second cam surface shaped so that when said nut is turned toward said spreader said first and second cam surfaces engage to secure said arms in use position.

2. A device according to claim 1 in which said first means comprises an eye on the first end of said stem and in which at least some of said points fit into said eye when said arms are in storage position.

3. A device according to claim 1 in which said spreader comprises a disk on said stem and said second means comprises a bolt disposed on a chord of said disk intersecting said slot and passing through an aperture in said arm.

4. A device according to claim 1 in which said spreader comprises a hub on said stem, radial spaced spacer arms projecting from said hub parallel to a radius and said second means comprises a bolt through aligned holes in said first-named arm and said spacer arm.

5. A device according to claim 1 in which said speader is threaded onto said stem and is adjustable in position on said stem.

6. A device according to claim 1 in which said nut has a concave underside which comprises said second cam surface and each said arm has a convex upper end which comprises said first cam surface.

7. A device according to claim 1 in which said spreader comprises a disk on said stem and said second means comprises a pin disposed on a chord of said disk intersecting said slot and passing through an aperture in said arm and means for securing said pin to said disk.

* * * * *